United States Patent [19]

Rowell

[11] Patent Number: 5,063,674

[45] Date of Patent: Nov. 12, 1991

[54] VEGETABLE SLICER

[75] Inventor: Geoffrey D. Rowell, Padstow, Australia

[73] Assignee: Tatham Cutlery Manufacturing Company Pty Limited, New South Wales, Australia

[21] Appl. No.: 585,093

[22] PCT Filed: Apr. 5, 1989

[86] PCT No.: PCT/AU89/00145

§ 371 Date: Sep. 25, 1990

§ 102(e) Date: Sep. 25, 1990

[87] PCT Pub. No.: WO89/09683

PCT Pub. Date: Oct. 19, 1989

[30] Foreign Application Priority Data

Apr. 5, 1988 [AU] Australia ..... PI7590

[51] Int. Cl.[5] ..... B26B 3/04; B26B 3/03; B26B 3/02

[52] U.S. Cl. ..... 30/305; 30/299; 30/303

[58] Field of Search ..... 30/165, 299, 302, 303, 30/304, 305, 315; 63/651

[56] References Cited

U.S. PATENT DOCUMENTS

| | | | |
|---|---|---|---|
| 1,656,415 | 1/1988 | Breitkrentz | 30/303 |
| 1,864,147 | 6/1932 | Rantine | 30/303 |
| 2,502,157 | 3/1950 | Klejna | 30/303 |
| 2,581,501 | 1/1952 | Shaver | 30/303 |
| 4,134,205 | 1/1979 | Heling | 30/303 |

*Primary Examiner*—Douglas D. Watts
*Assistant Examiner*—Paul M. Heyrana, Sr.
*Attorney, Agent, or Firm*—Kane, Dalsimer, Sullivan, Kurucz, Levy, Eisele and Richard

[57] ABSTRACT

A vegetable cutting device (1) moulded in at least three discrete parts, a main body member (2), at least one intermediate member (6) and a bottom member (10), each of which are adapted to engage together and retain a set of blades therebetween. At least two sets of transverse blades are provided such that vegetable slivers may be produced by passing vegetables therethrough. The blades are adapted to be maintained in position by sets of engaging teeth (3, 7 and 8, 12).

5 Claims, 5 Drawing Sheets

VEGETABLE SLICER

The present invention relates to a vegetable slicer of the 'julienne' type.

Hand-held vegetable slicing devices are presently known. The Applicant's Australian Patent No. 535399 discloses a bean slicing device constructed of a two part plastic moulding, each part having teeth enabling the two parts to interfit to form a comb joint, and having blades imprisoned between adjacent teeth across a window through which the bean to be sliced is passed. This prior art device is designed to slice beans into longitudinal strips.

Although these prior art devices offer a simple and cheap method of slicing vegetable pieces, because only one set of substantially parallel blades are used, the resulting strips of vegetable have varying widths due to the natural irregularity in size and shapes of vegetables.

Not only do the resulting slices look untidy and aesthetically poor, but also, cooking times of the different pieces are dissimilar, resulting in some pieces being overcooked and 'mushy' while some will be undercooked and 'crunchy'. This problem is particularly enhanced in recent times, with the widespread use of microwave ovens for cooking, which requires food to be prepared with even consistency for optimal uniform cooking.

The present invention seeks to overcome the disadvantages and drawbacks of prior art vegetable slicing devices by providing an improved vegetable cutting device which will cut vegetables into a plurality of longitudinal slivers of substantially uniform cross-section. Such a device provides slivers of vegetable which are of more advantageous size and shape, rendering the vegetables more aesthetically pleasing as well as more functionally useful prior to the cooking process. With the slivers of vegetable being of more uniform cross-sectional thickness, they will have substantially similar cooking time.

In one broad form the present invention provides a vegetable cutting device, comprising:

a main body member, having a window therethrough provided with a set of downwardly extending teeth on a pair of opposed sides thereof, and having a handle extending therefrom;

at least one intermediate member adapted to engage said main body member, provided with a window therethrough, and having, a first set of upwardly extending teeth provided on a first pair of opposed side thereof, and, a second set of downwardly extending teeth provided on a second pair of opposed sides thereof in a direction transverse to said first set of teeth;

a bottom member adapted to engaged with said main body member, provided with a window therethrough and having a set of upwardly extending teeth on a pair of opposed sides thereto; and, at least two transverse sets of blades, each adapted to engage between each of said upwardly and downwardly extending sets of teeth, respectively.

The present invention will become more fully understood from the following detailed description of a preferred embodiment thereof, in connection with the accompanying drawings, in which.

Figure 1:
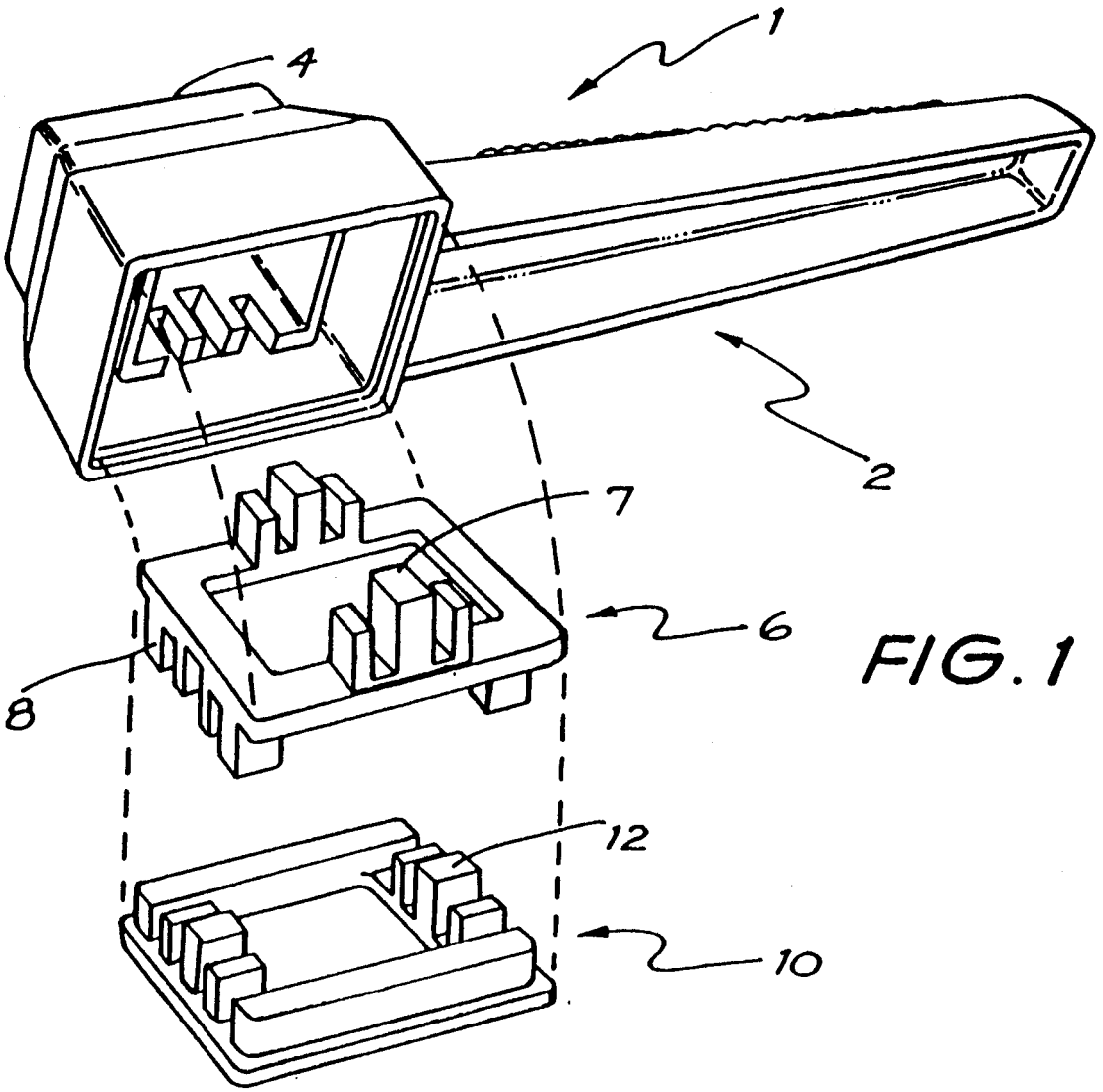
FIG. 1 illustrates an exploded isometric view of the vegetable cutting device in accordance with the present invention.
Figure 2:
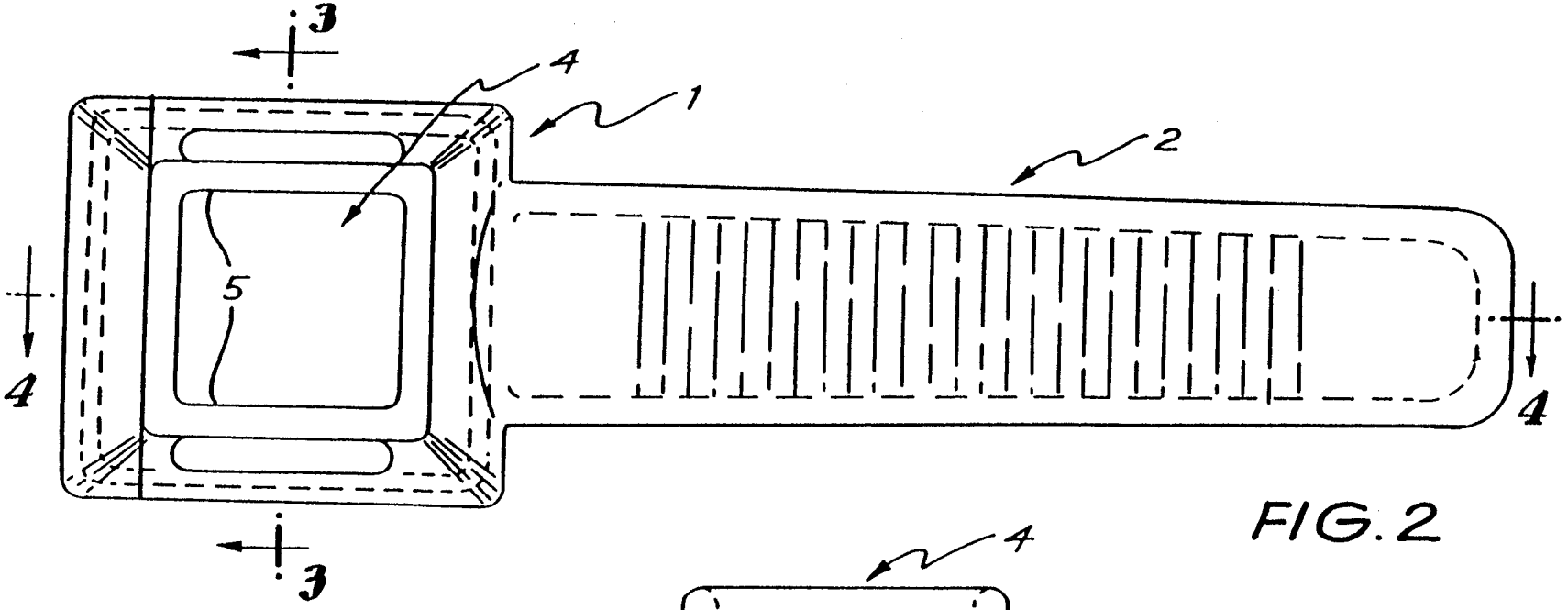
FIG. 2 shows a plan view of the handle and top body portion of the vegetable cutting device in accordance with the present invention.
Figure 3:
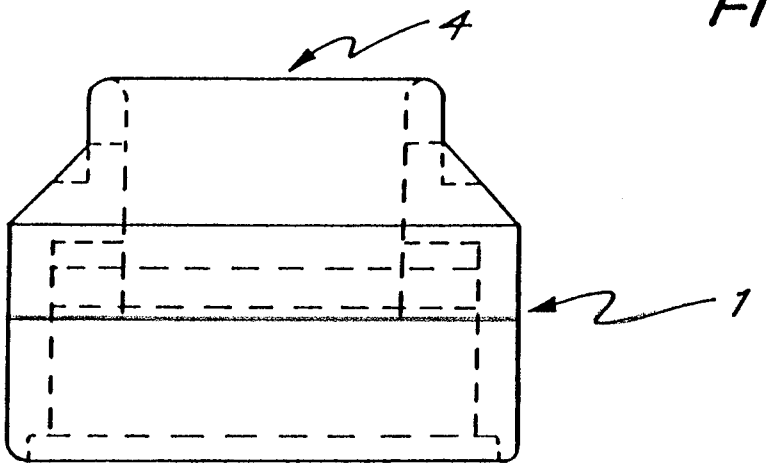
FIG. 3 illustrates a sectional end view along line B—B of the handle and body portion of FIG. 2.
Figures 4, 4A:
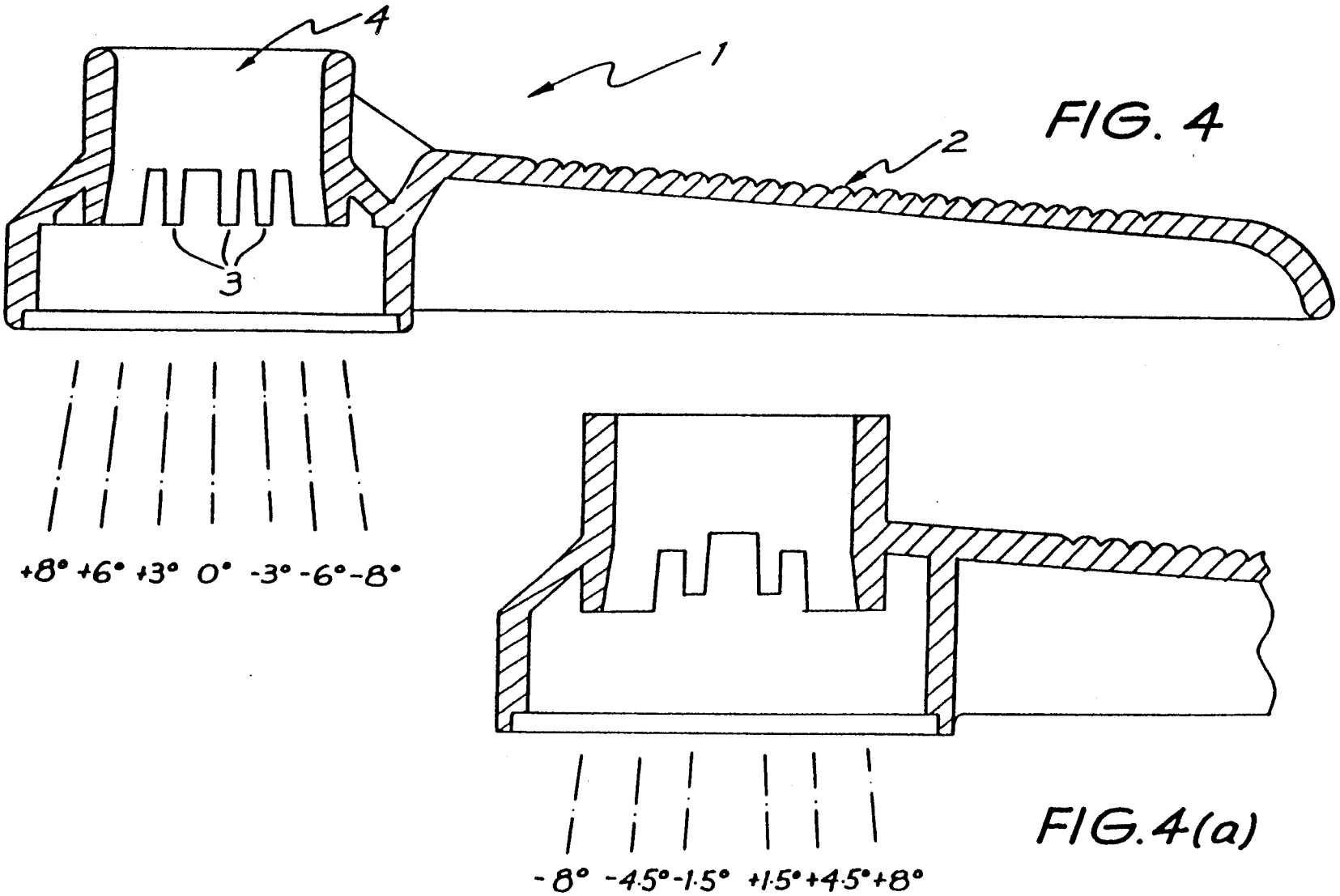
Figure 5:
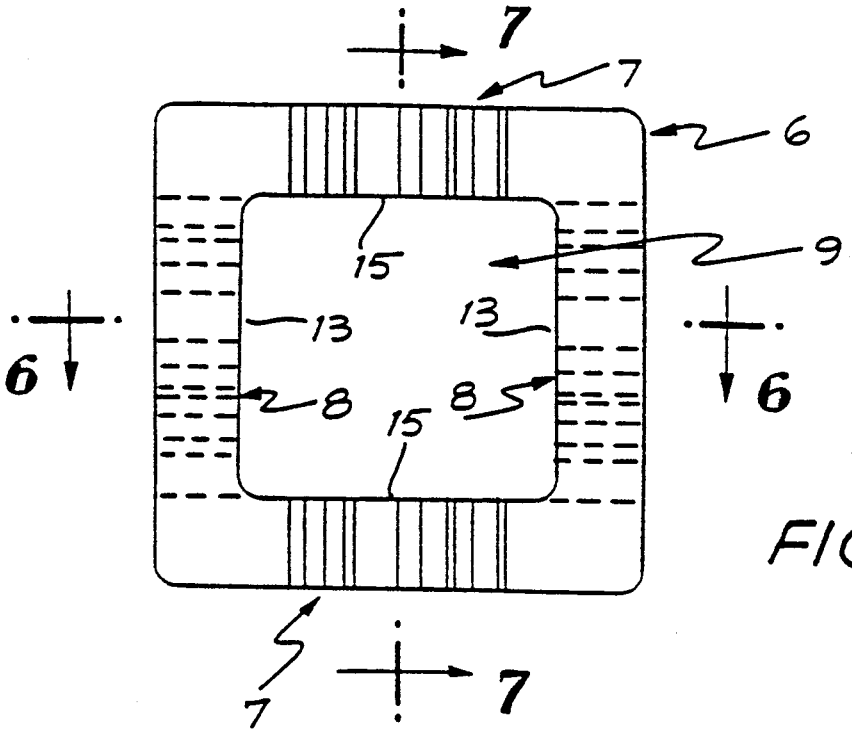
Figure 6:
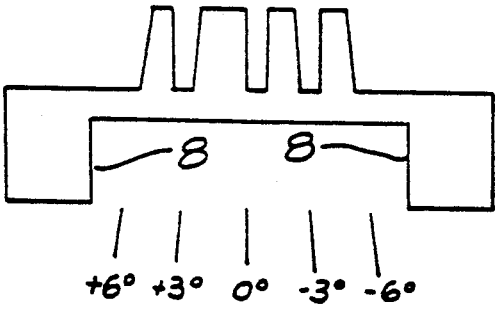
Figure 7:
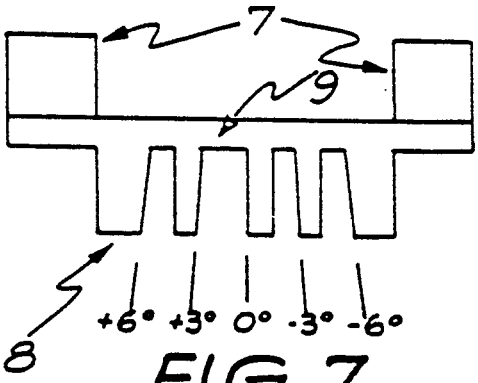
Figure 6A:
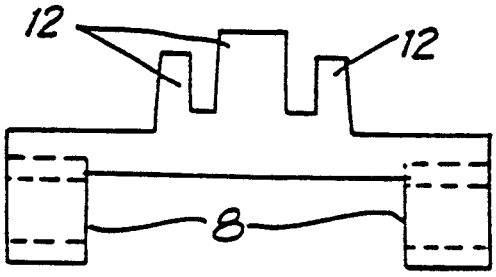
Figure 7A:
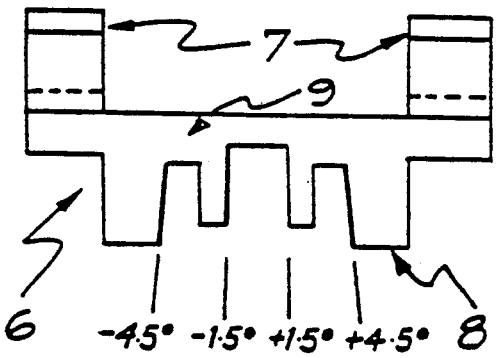
Figure 8:
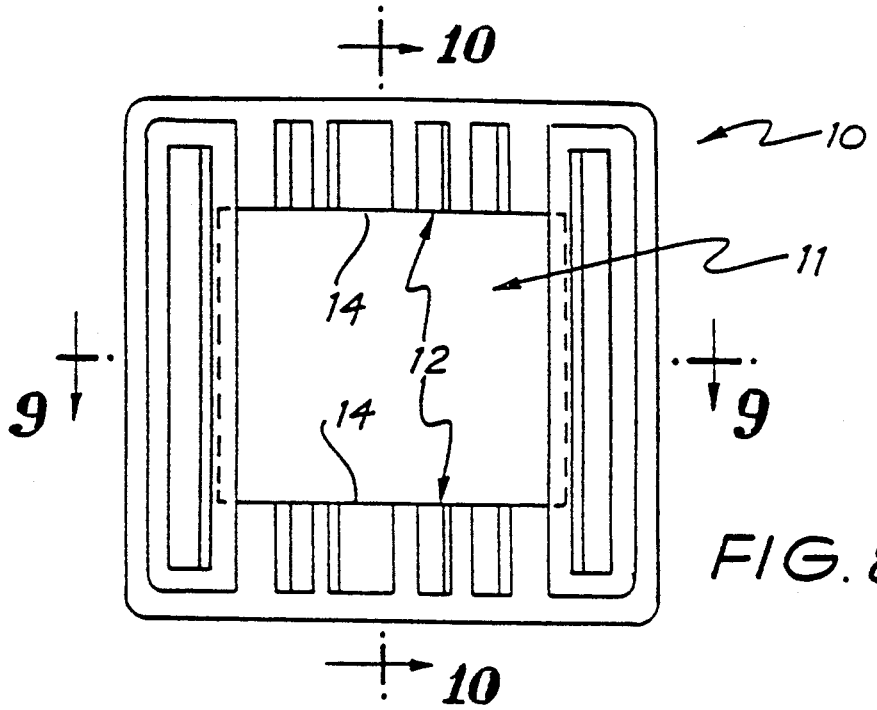
Figure 9:
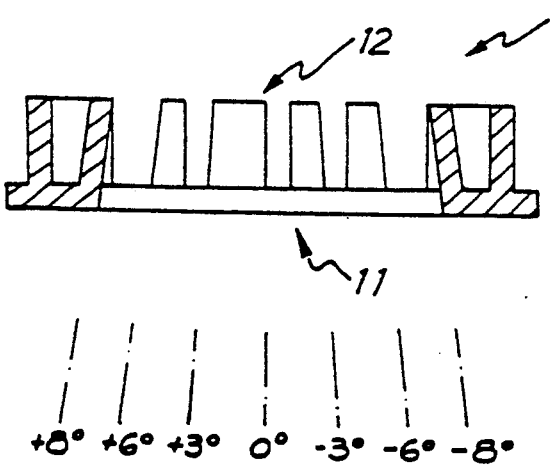
Figure 9A:
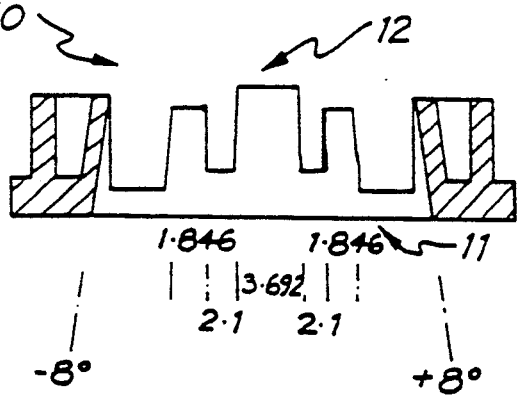
Figure 10:
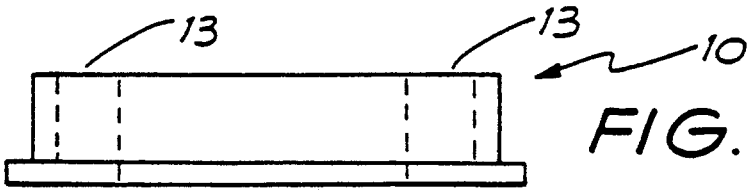

FIG. 4 and FIG. 4(*a*) detail sectional side views along line A—A of two preferred embodiments of the handle and body portion of FIG. 2;

FIG. 5 shows a plan view of the intermediate moulded portion of the vegetable cutting device of the present invention;

FIG. 6 and FIG. 6(*a*) illustrate sectional views along line C—C of FIG. 5;

FIG. 7 and FIG. 7(*a*) illustrate a sectional views along lines D—D of FIG. 5;

FIG. 8 shows a plan view of the bottom portion of the vegetable slicing device of the present invention;

FIG. 9 and FIG. 9(*a*) detail sectional views along line E—E of the bottom portion of the vegetable slicer shown in FIG. 8;

FIG. 10 details sectional views along line F—F of the bottom portion of FIG. 8.

The vegetable cutting device according to the preferred embodiment of the invention is constructed of three discrete sections which are moulded separately and then assembled by means of high frequency welding or the like. During the assembly process, the blades are located at their required positions between the moulded portions.

The first moulding, comprising the main body and handle portion of the vegetable cutting device 1 has an integrally moulded handle 2 extending therefrom and a square window 4 passing through said moulding 1. Across two mutually parallel opposed sides 5 of the window 4, are provided a set of downwardly directed teeth.

The second moulding 6 comprises the intermediate portion of the vegetable cutting device. This second moulding also has a square window 9 therethrough with upwardly directed teeth 7 provided on two mutually opposite sides 15 of the window 9 and adapted to interengage with the downwardly directed teeth 3 of the first moulding 1. On the other two mutually opposite sides 13 of the window 9 transverse to the direction of the teeth 7, are provided a second set of downwardly directed teeth 8.

The bottom portion of the vegetable slicing device is constructed of a third moulding 10 which again has a square window 11 therethrough with upwardly directed teeth 12 provided on two mutually opposite sides 14 of the window 11, said teeth 12 being adapted to interengage with the downwardly directed teeth 8 of the second moulding 6.

The blades (not shown) are trapped between the faces of the teeth 3 and 7 and the faces of teeth 8 and 12 to form two discrete sets of blades. Each of the blades of each set are preferably provided in slightly downwardly divergent relationship, such that as the vegetable is passed therethrough, each sliver becomes separated. The blades of each set of may be provided in a planar relationship against two sides of the teeth, as illustrated in FIGS. 4, 4*a*, 6, 6*a*, 7, 7*a*, 9 and 9*a* or may provided such that the central blades of each set of blades are provided in a more upwardly inclusive position relative to the outer blades of each set of blades as shown in FIGS. 4(*a*), 6(*a*), 7(*a*) and 9(*a*), such that the resistance to slivers of vegetables passing through them is reduced.

Each of the three discrete portions 1, 6 and 10 are preferably moulded of rigid plastics material by means of injection moulding or the like. Once fabricated, the three moulded portions are assembled together, the two sets of blades being positioned therebetween. Once assembled, the discrete portions may be subjected to high frequency welding or the like, to form a permanent bond therebetween.

It will become obvious to persons skilled in the field that numerous variations and modifications may be made to the vegetable cutting device as herein described. Such variations and modifications, some examples of which will be hereinafter disclosed, should be considered to be within the spirit and scope of the invention.

For example, an alternative construction would be to provide the two blade sets running at angles other than 90° to each other, to produce diamond shaped pieces.

The blade spacing of the first set may be different from that of the second set.

Although the invention has hereinbefore described as a three part moulding, an obvious alternative construction provides the said third part with a further set of downwardly directed teeth about the window through it and a fourth moulding, also with a window therethrough and a set of upwardly directed teeth to interengage with the downwardly directed teeth of the third part and a third blade set to be trapped between the teeth and extending across the window in a direction different from the first and second blade set. It will become obvious that any number of sets of blades may be provided at any angles, according to the size and shape of the desired vegetable pieces.

The julienne device of the present invention provides a cheap and easily manufactured hand held vegetable slicer to slice vegetable matter and other foodstuffs, etc. into longitudinal strips, the majority of which have a substantially uniform cross section, consequently enabling similar cooking times and producing sliced vegetables which appear aesthetically pleasing to the eye.

Numerous other variations and modifications of the vegetable cutting device will become obvious to persons skilled in the field, and such should be considered to fall within the scope of the present invention as described and claimed herein.

I claim:

1. A vegetable cutting device, comprising:

a main body member, having a window therethrough provided with a set of downwardly extending teeth on a pair of opposed sides thereof, and having a handle extending therefrom;

at least one intermediate member adapted to engage said main body member, provided with a window therethrough, and having, a first set of upwardly extending teeth provided on a first pair of opposed side thereof, and, a second set of downwardly extending teeth provided on a second pair of opposed sides thereof in a direction transverse to said first set of teeth;

a bottom member adapted to engaged with said intermediate body member, provided with a window therethrough and having a set of upwardly extending teeth on a pair of opposed sides thereto; and, at least two transverse sets of blades, each adapted to engage between each of said upwardly and downwardly extending sets of teeth, respectively.

2. A vegetable cutting device as claimed in claim 1 wherein each of said sets of teeth are provided such that the sides of those teeth which are adapted to engage said blades are slightly inclined in a downwardly diverging direction such that the resistance to slivers of vegetables passing between them is reduced.

3. A vegetable cutting device as claimed in claim 1 wherein each of said sets of teeth are provided such that those teeth in the centre of said sets of teeth are slightly elevated in position such that the central blades of each set of blades are provided in a more upwardly inclined position relative to the outer blades of each set of blades, such that the resistance to slivers of vegetables passing between them is reduced.

4. A vegetable cutting device as claimed in claim 1, wherein one intermediate member is provided and wherein two sets of blades are provided, each set being substantially perpendicular to the other.

5. A vegetable cutting device as claimed in claim 1, wherein said main body member, said intermediate member and said base member are moulded of plastics material and joined by high frequency welding.

* * * * *